US005079790A

United States Patent [19]

Pouch

[11] Patent Number: 5,079,790

[45] Date of Patent: Jan. 14, 1992

[54] FOAM CUSHION FOR USE WITH A WHEEL CHAIR

[76] Inventor: William H. Pouch, P.O. Box 26688, Greenville, S.C. 29616-1688

[21] Appl. No.: 590,917

[22] Filed: Oct. 1, 1990

[51] Int. Cl.[5] ..... A47C 20/00

[52] U.S. Cl. ..... 5/431; 5/481; 5/461; 5/464; 297/DIG. 1; 297/DIG. 4

[58] Field of Search ..... 5/481, 461, 468, 431, 5/448, 464; 297/DIG. 4, DIG. 1

[56] References Cited

U.S. PATENT DOCUMENTS

| | | | |
|---|---|---|---|
| 2,659,418 | 11/1953 | Berman | 5/481 |
| 2,785,739 | 3/1957 | McGregor | 5/481 |
| 3,337,884 | 8/1967 | Meier | 5/481 |
| 3,679,263 | 7/1972 | Cadiou | 297/DIG. 1 |
| 3,987,507 | 10/1976 | Hall | 297/DIG. 1 |
| 4,646,374 | 3/1987 | Shafer | 5/481 |
| 4,660,238 | 4/1987 | Jay | 5/431 |
| 4,753,480 | 6/1988 | Morell | 5/464 |
| 4,768,251 | 9/1988 | Baskent | 5/481 |
| 4,837,881 | 6/1989 | Kondo | 5/481 |

FOREIGN PATENT DOCUMENTS

| | | | |
|---|---|---|---|
| 887339 | 10/1942 | France | 5/468 |
| 639546 | 11/1983 | Switzerland | 5/464 |
| 857594 | 1/1961 | United Kingdom | 5/481 |

*Primary Examiner*—Gary L. Smith
*Assistant Examiner*—F. Saether
*Attorney, Agent, or Firm*—Cort Flint

[57] ABSTRACT

A wheel chair cushion and the like is disclosed which includes a cushion formed of a deformable resilient material. The cushion includes a base having a front wall and a rear wall. A plurality of individual foam springs are carried by the base having support surfaces which lie in a plane that is inclined to the base surface of said base as extending from said front wall to said rear wall. A pressure relief cut-out is formed substantially in its entirety from a mid-line of said cushion rearwardly so as to be disposed underneath the buttocks of a person sitting on the cushion to relieve pressure in that area and provide increased compressibility of the foam springs in the pressure relief area to disperse pressure and provide a resilient depression in the cushion to enhance the patient retention capability of the cushion as used in a wheel chair.

9 Claims, 2 Drawing Sheets

FOAM CUSHION FOR USE WITH A WHEEL CHAIR

BACKGROUND OF THE INVENTION

The invention relates to a wheel chair cushion, and more particularly to a patient retaining cushion for a wheel chair having pressure distribution features to provide enhanced blood circulation and reduce the possibility of decubitus ulcers.

Foam cushions have been utilized as wheel chair cushions including foam cushions having what is commonly known as convoluted support surfaces commonly found in mattress overlay products. It is also known to make wheel chair cushions in the form of foam wedges to help prevent the patient from sliding down in the wheel chair. U.S. Pat. No. 4,646,374 discloses an orthotic sling seat cushion for a wheel chair and the like which comprises an elongated foam wedge having a substantially planar top surface. The bottom of the cushion slopes progressively upward toward the top of the cushion to provide the desired pelvic tilt when used on a sling wheel chair type seat. Recently, the use of straps or other means of tying or securing a patient within a wheel chair to prevent them from falling out of the wheel chair have been greatly restricted. This leaves many wheel chair ridden patients without an effective means of retention in the wheel chair if they should lose control of their position. U.S. Pat. No. 4,901,387 discloses the expedient of individual foam springs with an upper trapezoidal profile and longitudinal and lateral spacing in a mattress overlay whereby the foam springs act relatively independently to disperse pressure.

Accordingly, an important object of the present invention is to provide a pressure distributing and circulation enhancing cushion for a wheel chair and the like having patient retention capabilities.

Another object of the invention is to provide a foam cushion for a wheel chair and the like which is wedge shaped for patient retention yet has an enhanced pressure distribution and circulation enhancing upper surface comprised of individual foam springs.

Another object of the present invention is to provide an improved patient retaining wheel chair cushion constructed from foam rubber having enhanced pressure relief features for reducing decubitus ulcers.

SUMMARY OF THE INVENTION

The above objectives are accomplished according to the present invention by providing a foam cushion having a base and an upper support surface with longitudinal and lateral air channels defining individual foam springs. The foam springs have support surfaces which are inclined to the base of the cushion so that the supporting surfaces of the foam springs line in a plane inclined rearwardly for patient retention. The foam springs act individually for distributing pressure over the occupant's body and cushion while a cavity in the base surface provides pressure relief in the rearward half of the cushion.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DETAILED DESCRIPTION OF A PREFERRED EMBODIMENT

Referring now in more detail to the drawings, a foam cushion, designated generally as A, is provided for a mattress, cushion, and the like constructed from polyurethane foam such as 1.4–3.0 density foam material with an ILD in the 30 to 40 range. The cushion is constructed having an overall thickness of approximately 3.75 inches at a front wall 8*a*, and a thickness of 2.75 inches at a rear wall 8*b* providing a rearwardly tapered wedge shape to provide cushioning and support. Individual foam springs, designated generally as B, have a square cross-section of approximately 1½ inches and a height of approximately 1¼ inches. Channels of approximately ¼ inch wide are formed in the foam material longitudinally and laterally to isolate each foam spring and provide air circulation. In addition to supporting and cushioning a person's body, the cushion provides redistribution of body weight to reduce pressure at strategic points of the body and reduce the formation of decubitus ulcers in the case of prolonged sitting when used by a medical patient. The chemistry and performance of the foam material may vary depending on the application being made. For wheel chair use, foam having a density of 2.5 and ILD of 45 is preferred. However, the invention may have utility in seats, geri-chairs, and dialysis chairs, etc.

Figure 1:
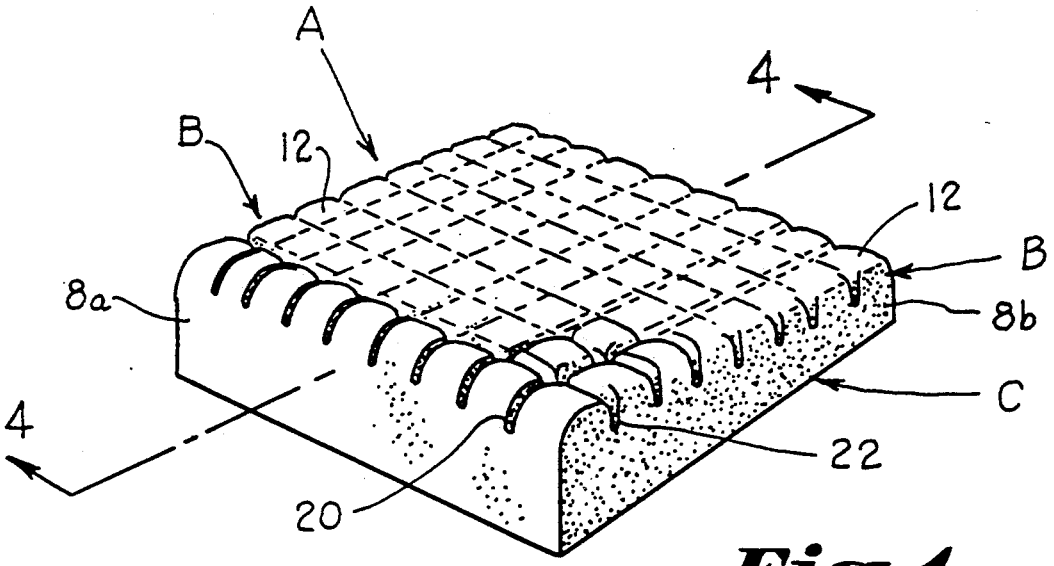
FIG. 1 is a perspective view of a wheel chair cushion constructed in accordance with the present invention.
Figure 2:
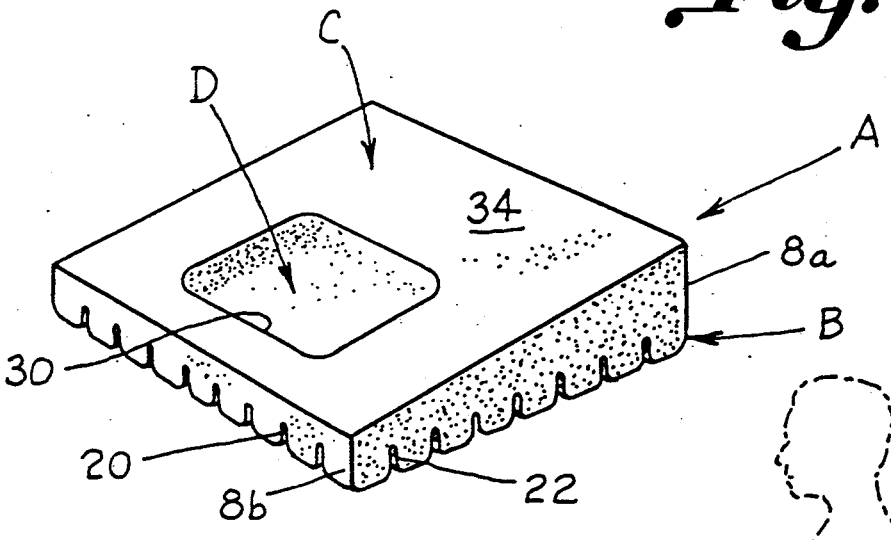
FIG. 2 is a perspective view taken from the bottom of a wheel chair cushion constructed according to the invention.
Figure 3:
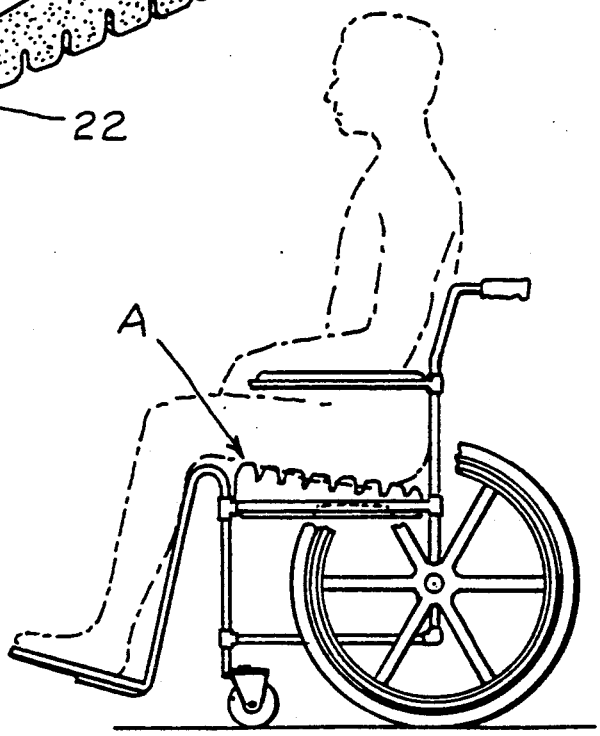
FIG. 3 is a side elevation of a wheel chair cushion constructed in accordance with the present invention with a person seated on the seat of a wheel chair.

As can best be seen in FIGS. 1 and 2, cushion A includes a rectangular foam base C on which a plurality of individual foam springs B are carried. Each foam spring includes a rectangular base block 10 and a horizontally planar support surface 12 at a correct level for support. A converging solid body in the form of a polyhedron 14 extends between base block 10 and planar surface 12. Polyhedron 14 includes 4 trapezoidal planar faces 16 which converge upwardly to planar surface 12. Preferably, the base of polyhedron 14 co-extends with the perimeter of base block 10.

Figure 4:
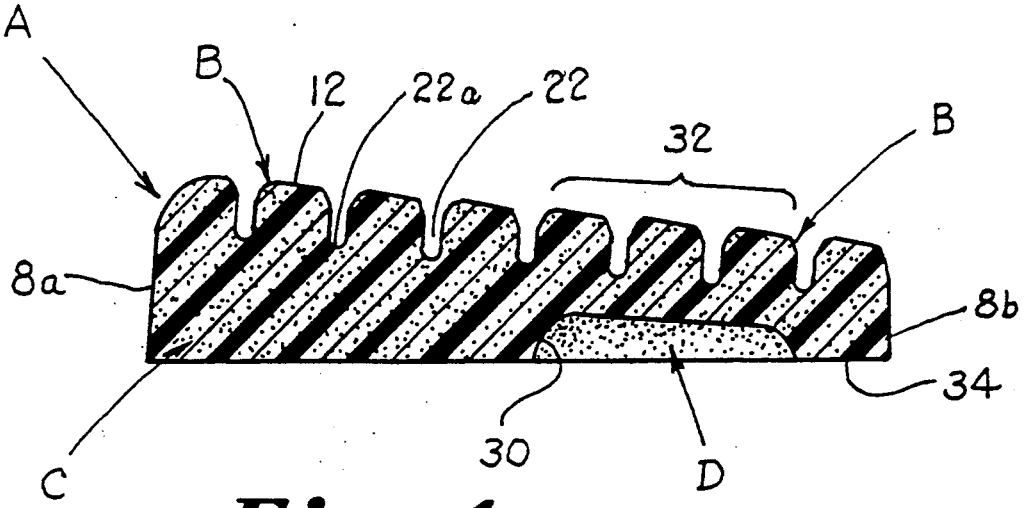
FIG. 4 is a sectional view taken along line 4—4 of FIG. 1.
Figure 5:
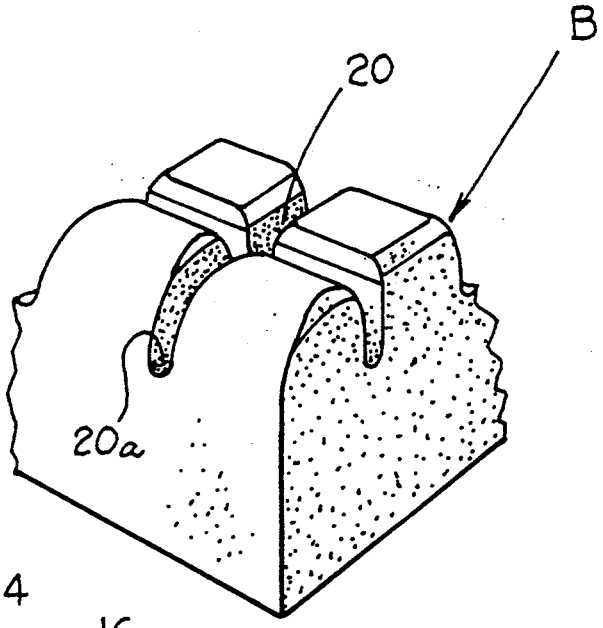
FIG. 5 is an enlarged perspective of a part of a wheel chair cushion constructed in accordance with the present invention illustrating individual foam springs.
Figure 6:
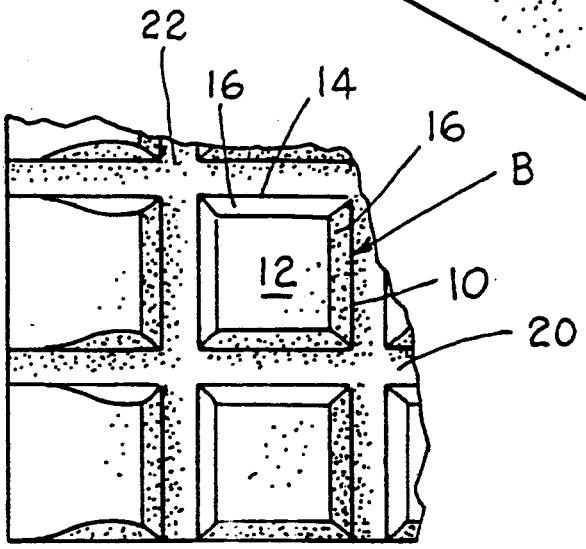
FIG. 6 is a partial top plan view of a wheel chair cushion constructed in accordance with the present invention.

As can best be seen in FIGS. 4 and 6, there are a plurality of longitudinal air channels 20 and lateral air channels 22 surrounding each individual foam spring B. Channels 20, 22 are dimensioned sufficiently so that foam springs B may act individually and together in groups to support, cushion, and relieve body pressure in an effective manner. For example, channels 20,22 preferably have a width of approximately ¼ inch while a width in the range of ⅛ to ⅜ inch may be used. The height of the foam spring for consumer use may vary, for example, from approximately 1 to 1½ inches. In one embodiment, a foam material of 1.4 to 1.5 pounds was used. The combination of geometric design, individualized foam springs, and density of foam material has been found to provide a highly effective foam cushion for cushioning, supporting, and reducing pressure while seated in a wheel chair and the like. Support surfaces 12 provide the correct level of support to the different parts of the seated buttocks. The channels enable the foam springs to act individually and independently or in groups to support the heavier parts of the body. These individual springs can move in any direction without interfering with each other in a horizontal plane to significantly reduce pressure against the skin. In essence, the body is cushioned and moves with the surface as opposed to being moved against the surface which creates shearing or abrasion pressure on the skin.

As can best be seen in FIG. 4, the support surfaces 12 of foam springs B lie in a plane which is inclined to the plane of a bottom surface 34 of base C. This assists in retaining the patient in the wheel chair. The bottom 22*a* of lateral channels 22 preferably vary in distance from a bottom surface 34 of base C, as can best be seen in FIG. 4. The bottoms 20*a* of longitudinal channels 20 preferably are inclined to bottom surface 34 of base C at an angle generally equal to the angle of inclination of the plane in which support surfaces 12 lie.

As can best be seen in FIGS. 2 and 4, pressure relief means D formed in base C relieves pressure in the critical area of the buttocks of the person seated on the cushion which includes the area of bony prominence. Pressure relief means D includes a cavity 30 in the form of a rectangular cut-out or void of foam material. Cavity 30 is underneath the rearward portion of the cushion formed substantially in its entirety rearward of the mid-section of the cushion, as can best be seen in FIG. 4. This places the bony prominence of the buttocks of the person seated on the cushion directly over pressure relief cavity 30. Foam springs B in the area 32 directly above cavity 30 have increased resiliency and compression due to the cavity. This provides two important functions. First, it relieves pressure against the heavier portions and bony prominence of the buttocks to distribute pressure more evenly over the remaining portions of the person's buttocks when seated on the cushion, and it allows the top of the cushion to be more depressed resulting in a more concave opening in which the occupant's buttocks conforms. This assists in retaining the occupant in the wheel chair due to the frictional engagement of the cushion with the wheel chair and the dipping of the patient with the cushion. All of the foam springs resiliently engage to frictionally grip the person seated on the cushion, and, together with the wedge shape of the cushion, effectively assist in retaining the person in the wheel chair.

While a preferred embodiment of the invention has been described using specific terms, such description is for illustrative purposes only, and it is to be understood that changes and variations may be made without departing from the spirit or scope of the following claims.

What is claimed is:

1. A foam cushion for a wheel chair seat constructed from a resilient deformable foam material, said cushion having a support surface for evenly dispensing supporting pressure generally over the buttocks of a person's body while disposed in a seated position in said wheel chair, said cushion comprising:

a base having a generally planar lower surface supported by said wheel chair;

a plurality of one-piece foam springs for supporting and cushioning the body of a person;

said foam springs defining a plurality of blocks which are formed integral at a first end with said base and which form at a second end a plurality of generally planar support surfaces;

a plurality of longitudinal and lateral channels, the lateral channels terminating at said base at unequal locations from said lower surface, said channels separating said foam springs; and said planar support surfaces of said foam springs lying in a plane which is inclined to the plane of said lower planar surface of said base of said cushion for assisting in person retention in said chair;

a pressure relief means formed as a cavity in the bottom surface to extend from substantially a mid-section between front and back walls of said cushion rearwardly to a location in the vicinity of said back wall for relieving pressure against the bony prominence of the buttocks of the person seated on said cushion.

2. The device of claim 1 wherein the thickness of said cushion is a minimum in the area of said pressure relief means in which a portion of said base is void of material.

3. The device of claim 2 wherein the thickness of said cushion in the area of said pressure relief means is about one-half the cushion thickness in adjacent areas.

4. The device of claim 1 wherein, the distance between lower ends of said lateral channels and said planar lower surface varies between the front and back walls of said cushion in accordance with the tapered thickness of said cushion.

5. The device of claim 1 wherein said longitudinal channels have lower ends which are inclined to said planar lower surface and are parallel to said plane of said support surfaces.

6. A foam cushion for a chair seat constructed from a resilient deformable foam material, said cushion having a support surface for evenly dispensing supporting pressure generally over a person's entire body while disposed in a seated position in said wheel chair, said cushion comprising:

a rectangular foam base;

a plurality of individual foam springs carried by said rectangular base having support surfaces;

said support surfaces of said foam springs lying in a plane, spaced from to said planar base; and a pressure relief means formed as a cavity in a bottom surface to extend from substantially a mid-section between front and back walls of said cushion rearwardly to a location in the vicinity of said back wall for relieving pressure against the bony prominence of the buttocks of the person seated on said cushion.

7. The device of claim 6 wherein said cavity forming said pressure relief means is devoid of foam material.

8. The device of claim 6 wherein the distance from said support surfaces of said foam springs to said planar support surface varies in accordance with the tapered thickness of said cushion.

9. The device of claim 6 wherein the thickness of said cushion in the area of said cavity if about one-half that of the thickness of the remainder of said cushion.

* * * * *